US010923031B2

(12) United States Patent
Yang et al.

(10) Patent No.: US 10,923,031 B2
(45) Date of Patent: Feb. 16, 2021

(54) PIXEL UNIT CIRCUIT, PIXEL CIRCUIT, METHOD FOR DRIVING PIXEL CIRCUIT AND DISPLAY DEVICE

(71) Applicant: BOE Technology Group Co., Ltd., Beijing (CN)

(72) Inventors: Shengji Yang, Beijing (CN); Xue Dong, Beijing (CN); Xiaochuan Chen, Beijing (CN); Hui Wang, Beijing (CN); Yanming Wang, Beijing (CN); Pengcheng Lu, Beijing (CN); Wei Liu, Beijing (CN); Huijuan Wang, Beijing (CN); Minghua Xuan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 128 days.

(21) Appl. No.: 16/087,972

(22) PCT Filed: Feb. 12, 2018

(86) PCT No.: PCT/CN2018/076516
§ 371 (c)(1),
(2) Date: Sep. 24, 2018

(87) PCT Pub. No.: WO2019/015318
PCT Pub. Date: Jan. 24, 2019

(65) Prior Publication Data

US 2020/0184892 A1 Jun. 11, 2020

(30) Foreign Application Priority Data

Jul. 17, 2017 (CN) ..... 2017 1 0581734

(51) Int. Cl.
*G09G 3/3233* (2016.01)
*G09G 3/3258* (2016.01)

(52) U.S. Cl.
CPC ..... *G09G 3/3258* (2013.01); *G09G 3/3233* (2013.01); *G09G 2310/0251* (2013.01); *G09G 2320/0257* (2013.01)

(58) Field of Classification Search
CPC ..... G09G 3/3258; G09G 3/3233; G09G 2320/0257; G09G 2310/0251
See application file for complete search history.

(56) References Cited

U.S. PATENT DOCUMENTS

2006/0238475 A1* 10/2006 Oh ..... G09G 3/3233 345/92
2008/0169754 A1* 7/2008 Yang ..... G09G 3/3233 313/504

(Continued)

FOREIGN PATENT DOCUMENTS

CN 1547183 A 11/2004
CN 102903324 A 1/2013

(Continued)

OTHER PUBLICATIONS

International Search Report and Written Opinion, including English translation of Box V of the Written Opinion, for International Application No. PCT/CN2018/076516, dated May 11, 2018, 14 pages.

*Primary Examiner* — Carolyn R Edwards
(74) *Attorney, Agent, or Firm* — Westman, Champlin & Koehler, P.A.

(57) ABSTRACT

A pixel unit circuit includes a light emitting element, a first end being connected to a low level input end; a storage capacitor sub-circuit, a first end being connected to a DC voltage input end; a driving transistor, a gate electrode being connected to a second end of the storage capacitor sub-circuit, and a first electrode being connected to a second end of the light emitting element; a light emitting control sub-circuit, a control end being connected to a light emitting (Continued)

control line, the first end being connected to a high-level input end, and the second end being connected to a second electrode of the driving transistor, and configured to control whether the second electrode of the driving transistor is connected to the high level input end; and a charge compensation control sub-circuit, connected to a gate line, a data line and the gate electrode of the driving transistor.

12 Claims, 11 Drawing Sheets

(56) References Cited

U.S. PATENT DOCUMENTS

2009/0309516 A1* 12/2009 Kim ..... G09G 3/3233 315/307
2010/0164847 A1* 7/2010 Lee ..... G09G 3/3233 345/77
2011/0115772 A1* 5/2011 Chung ..... G09G 3/3233 345/211
2012/0038683 A1* 2/2012 Park ..... G09G 3/3233 345/690
2012/0162176 A1* 6/2012 Kim ..... G09G 3/3258 345/211
2013/0027373 A1 1/2013 Kitazawa
2013/0201172 A1* 8/2013 Jeong ..... G09G 3/3258 345/212
2015/0213756 A1* 7/2015 Wacyk ..... G09G 3/006 345/690
2018/0158401 A1 6/2018 Wang et al.
2018/0315374 A1* 11/2018 Zhang ..... G09G 3/3258

FOREIGN PATENT DOCUMENTS

CN 203858847 U 10/2014
CN 104217674 A 12/2014
CN 105047138 A 11/2015
CN 106847189 A 6/2017
CN 107170407 A 9/2017

* cited by examiner

PIXEL UNIT CIRCUIT, PIXEL CIRCUIT, METHOD FOR DRIVING PIXEL CIRCUIT AND DISPLAY DEVICE

CROSS-REFERENCE TO RELATED APPLICATION

The present application is the U.S. national phase of PCT Application No. PCT/CN2018/076516 filed on Feb. 12, 2018, which claims a priority of the Chinese patent application No. 201710581734.7 filed for the SIPO on Jul. 17, 2017, which are incorporated herein by reference in their entirety.

TECHNICAL FIELD

The present disclosure relates to the field of display technology, in particular to a pixel unit circuit, a pixel circuit, a method for driving the pixel circuit and a display device.

BACKGROUND

Microelectronics and optoelectronics are combined to apply for Silicon-based OLED (Organic Light emitting Diode) micro-displays. OLED technology and CMOS (Complementary Metal Oxide Semiconductor) technology are integrated to promote the development of a new generation of micro-displays, and promote the research and development of silicon-based organic electrons and even silicon-based molecular electrons.

The silicon-based OLED micro-displays in the related art cannot effectively adjust the brightness of the micro OLED itself, and has dynamic afterimage, and a range of the data voltages on the data line is narrow, so that the brightness of the OLED cannot be effectively improved.

SUMMARY

An object of the present disclosure is to provide a method and a device for indicating a UE capability, a UE and a base station, so as to solve the problem in the related art where it is impossible for the UE to achieve the relevant functions in In one aspect, a pixel unit circuit includes a light emitting element, a first end of the light emitting element being connected to a low level input end; a storage capacitor sub-circuit, a first end of the storage capacitor sub-circuit being connected to a DC voltage input end; a driving transistor, a gate electrode of the driving transistor being connected to a second end of the storage capacitor sub-circuit, and a first electrode of the driving transistor being connected to a second end of the light emitting element; a light emitting control sub-circuit, a control end of the light emitting control sub-circuit being connected to a light emitting control line, the first end of the light emitting control sub-circuit being connected to a high-level input end, and the second end of the light emitting control sub-circuit being connected to a second electrode of the driving transistor, and configured to control whether the second electrode of the driving transistor receives a signal from the high level input end under the control of the light emitting control line; and a charge compensation control sub-circuit, connected to a gate line, a data line and the gate electrode of the driving transistor, and configured to control whether the gate electrode of the driving transistor receives a signal from the data line under the control of the gate line.

In some embodiment, the pixel unit circuit further includes a reset sub-circuit, connected to the light emitting control line, the first electrode of the driving transistor, and a reset voltage input end, and configured to control whether the first electrode of the driving transistor receives a signal from the reset voltage input end under the control of the light emitting control line.

In some embodiment, the reset sub-circuit comprises a reset switch transistor, a gate electrode of the reset switch transistor is connected to the light emitting control line, a first electrode of the reset switch transistor is connected to the first electrode of the driving transistor, a second electrode of the reset switch transistor is connected to the reset voltage input end.

In some embodiment, the light emitting control sub-circuit includes a light emitting control transistor, a gate electrode of the light emitting control transistor is connected to the light emitting control line, the first electrode of the light emitting control transistor is connected to the high level input end, and the second electrode of the light emitting control transistor is connected to the second electrode of the driving transistor, the light emitting control transistor is a p-type transistor, the reset switch transistor is an n-type transistor.

In some embodiment, the light emitting control sub-circuit includes a light emitting control transistor, a gate electrode of the light emitting control transistor is connected to the light emitting control line, the first electrode of the light emitting control transistor is connected to the high level input end, and the second electrode of the light emitting control transistor is connected to the second electrode of the driving transistor, the light emitting control transistor is an n-type transistor, the reset switch transistor is a p-type transistor.

In some embodiment, the pixel unit circuit further includes a potential control transistor, a gate electrode and a first electrode of the potential control transistor is connected to the first electrode of the driving transistor, the second electrode of the potential control transistor is grounded; the potential control transistor is a p-type transistor.

In some embodiment, the gate line includes a first gate switch line and a second gate switch line; the charging compensation control sub-circuit includes a first charge compensation control transistor, a gate electrode of the first charge compensation control transistor being connected to the first gate switch line, a first electrode of the first charge compensation control transistor being connected to a gate electrode of the drive transistor, and a second electrode of the first charge compensation control transistor being connected to the data line; and a second charge compensation control transistor, a gate electrode of the second charge compensation control transistor being connected to the second gate switch line, a first electrode of the second charge compensation control transistor being connected to the data line, and a second electrode of the second charge compensation control transistor being connected to a gate electrode of the drive transistor; the first charge compensation control transistor is an n-type transistor, and the second charge compensation control transistor is a p-type transistor.

In another aspect, a method for driving the pixel unit circuit, used for driving the above pixel unit circuit, the method includes: in a charging compensation phase, under the control of the light emitting control line, controlling, by the light emitting control sub-circuit, the second electrode of the driving transistor to receive a signal from the high level input end; under the control of the gate line, controlling, by the charging compensation control sub-circuit, the data voltage Vdata on the data line to be written to the gate electrode of the driving transistor, such that the driving transistor is turned on until a potential at the first electrode of the driving transistor becomes Vdata-Vth, the driving transistor being operated in a constant current region; Vth being a threshold voltage of the driving transistor; in a pixel light emitting phase, under the control of the light emitting control line, controlling, the light emitting control sub-circuit, the second electrode of the driving transistor to receive a signal from the high level input end, and the driving transistor being operated in a constant current region to drive the light emitting element to emit light.

In some embodiment, the pixel unit circuit further includes a reset sub-circuit, connected to the light emitting control line, the first electrode of the driving transistor, and the reset voltage input end, configured to control whether the first electrode of the driving transistor receives a signal from the reset voltage input end under the control of the light emitting control line, the reset voltage input end includes a ground end or a low level input end, before the charging compensation phase, the method for driving the pixel unit circuit further includes: in the reset phase, under the control of the light emitting control line, controlling, the reset sub-circuit, the first electrode of the drive transistor to receive a signal from the reset voltage input end, to reset the potential at the first electrode of the drive transistor; in the charging compensation phase and the pixel light emitting phase, under the control of the light emitting control line, controlling, the reset sub-circuit, the first electrode of the drive transistor not to receive a signal from the reset voltage input end.

In yet another aspect, a pixel circuit includes a plurality of gate lines, a plurality of data lines, a plurality of light emitting control lines, and a plurality of the pixel unit circuits, the plurality of the pixel unit circuit are arranged in an array form, pixel unit circuits in a same row are connected to a same gate lines, pixel unit circuits in the same column are connected to a same data line.

In still yet another aspect, a method for driving the pixel circuit is used for driving the pixel circuit, within a display frame time, one row of pixel unit circuits corresponds to a corresponding charging compensation phase and a corresponding pixel lighting phase; within the display frame time, the method for driving the pixel circuit includes: in the corresponding charging compensation phase, under the control of the corresponding light emitting control line, controlling, by the light emitting control sub-circuits of the pixel unit circuits in the corresponding row, the second electrodes of the driving transistors to receive a signal from the high level input end; under the control of the corresponding gate line, controlling, by the charge compensation control sub-circuits of the pixel unit circuits in the corresponding row, the data voltage Vdata of the corresponding data line to be written to the gate electrodes of the driving transistors included in the pixel unit circuits in the corresponding row, so that the driving transistors are turned on until the potential at the first electrodes of the driving transistors becomes Vdata-Vth, the driving transistors being operated in a constant current region; Vth being a threshold voltage of the driving transistor; in the corresponding pixel light emitting stage, under the control of the corresponding light emitting control line, controlling, by the light emitting control sub-circuits, the second electrodes of the driving transistors to receive a signal from the high level input end, and the driving transistors being operated in a constant current region, the light emitting elements being driven to emit light.

In some embodiment, the pixel unit circuit in the pixel circuit includes a reset sub-circuit, connected to the light emitting control line, the first electrode of the driving transistor, and the reset voltage input end, configured to control whether a first electrode of the driving transistor receives a signal from the reset voltage input end under the control of the light emitting control line; and the reset voltage input end comprises a ground end or a low level input end, the method further includes: setting a full-screen black insertion period between two adjacent display frame times; in the full-screen black insertion period, all light emitting control lines included in the pixel circuit outputting a first level signal, so that the second ends of the light emitting elements in each pixel unit circuit included in the pixel circuit all receiving a signal from the reset voltage input end.

In some embodiment, the pixel unit circuit in the pixel circuit includes a reset sub-circuit, connected to the light emitting control line, the first electrode of the driving transistor, and the reset voltage input end, and configured to control whether the first electrode of the driving transistor receives a signal from the reset voltage input end under the control of the light emitting control line; and the reset voltage input end includes a ground end or a low level input end, the method further including: alternately setting a plurality of full-screen black insertion periods within one display frame time; in the plurality of full-screen black insertion periods, all the light emitting control lines included in the pixel circuit outputting a first level signal, so that the second end of the light emitting element of each pixel unit circuit included in the pixel circuit receiving a signal from the reset voltage input end.

In some embodiment, the pixel unit circuit in the pixel circuit comprises a reset sub-circuit, connected to the light emitting control line, the first electrode of the driving transistor, and the reset voltage input end, and configured to control whether the first electrode of the driving transistor receives a signal from the reset voltage input end under the control of the light emitting control line; and the reset voltage input end includes a ground end or a low level input end, within one display frame period, the method further includes: the plurality of light emitting control lines included in the pixel circuit sequentially outputting the first level signal, so that the second ends of the light emitting elements of the plurality rows of pixel unit circuits included in the pixel circuit sequentially receiving a signal from the reset voltage input end.

In some embodiment, the pixel unit circuit in the pixel circuit includes a reset sub-circuit, connected to the light emitting control line, the first electrode of the driving transistor, and the reset voltage input end, and configured to control whether the first electrode of the driving transistor receives a signal from the reset voltage input end under the control of the light emitting control line; and the reset voltage input end includes a ground end or a low level input end, the method further comprises: each display frame time includes at least two display periods, within each display period, the plurality of light emitting control lines included in the pixel circuit sequentially outputting the first level signal, so that the second ends of the light emitting elements of the plurality rows of pixel unit circuits included in the pixel circuit sequentially receiving a signal from the reset voltage input end.

In still yet another aspect, a display device includes a silicon substrate and the pixel unit circuit arranged on the silicon substrate.

DETAILED DESCRIPTION OF THE EMBODIMENTS

Figure 1:
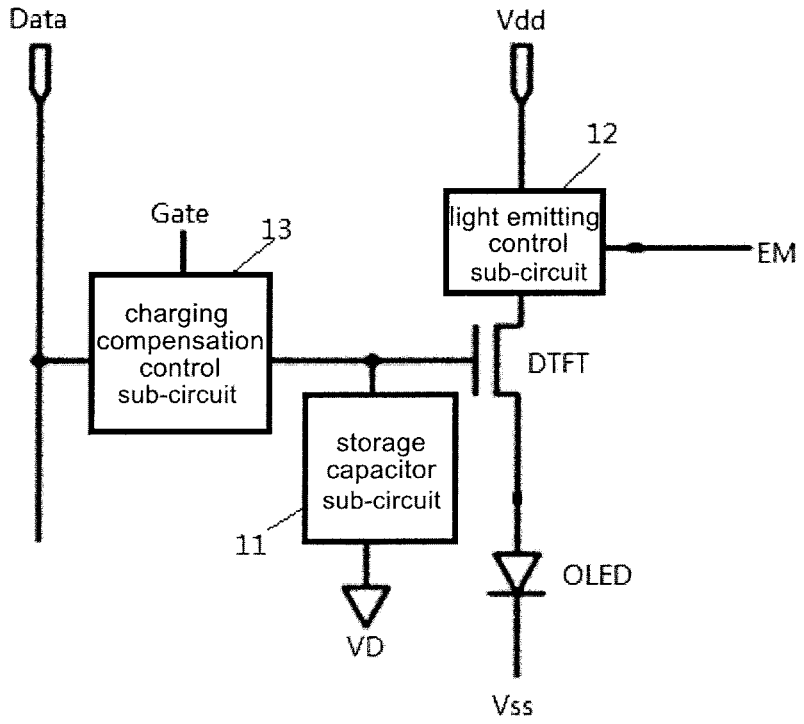
FIG. 1 is a structural diagram of a pixel unit circuit according to some embodiments of the present disclosure.

In order to make the objects, the technical solutions and the advantages of the present disclosure more apparent, the present disclosure will be described hereinafter in a clear and complete manner in conjunction with the drawings and embodiments. Based on the embodiments in the present disclosure, all other embodiments obtained by a person skilled in the art without creative work are all fall in the scope of the present disclosure.

The transistors in all embodiments of the present disclosure may each be a thin film transistor or a field effect transistor or other device having the same characteristics. In the embodiment of the present disclosure, in order to distinguish the two electrodes of the transistor except the gate electrode, one of them is referred to as a first electrode, and the other is referred to as a second electrode. In actual operation, the first electrode may be a drain electrode, and the second electrode may be a source electrode; or the first electrode may be a source electrode, and the second electrode may be a drain electrode.

The pixel unit circuit described in the embodiments of the present disclosure includes: a light emitting element, a first end of the light emitting element being connected to a low level input end; a storage capacitor sub-circuit, a first end of the storage capacitor sub-circuit being connected to a DC voltage input end; a driving transistor, a gate electrode of the driving transistor being connected to a second end of the storage capacitor sub-circuit, and a first electrode of the driving transistor being connected to a second end of the light emitting element; a light emitting control sub-circuit, a control end of the light emitting control sub-circuit being connected to a light emitting control line, the first end of the light emitting control sub-circuit being connected to a high-level input end, and the second end of the light emitting control sub-circuit being connected to a second electrode of the driving transistor, and configured to control whether the second electrode of the driving transistor is connected to the high level input end under the control of the light emitting control line (i.e., control whether the second electrode of the driving transistor is electrically connected to the high level input end under the control of the light emitting control line, so as to control whether the second electrode of the drive transistor receives a signal from the high level input); and a charge compensation control sub-circuit, respectively connected to a gate line, a data line and the gate electrode of the driving transistor, and configured to control whether the gate electrode of the driving transistor is connected to the data line under the control of the gate line (i.e., control whether the gate electrode of the driving transistor is electrically connected to the data line under control of the gate line, so as to control whether a gate electrode of the driving transistor receives a signal from the data line).

The pixel unit circuit of some embodiments of the present disclosure can effectively adjust the brightness of the light emitting element itself by adjusting the data voltage (the charge compensation control sub-circuit controls the potential of the second end of the light emitting element to be Vdata in the charge compensation phase with the cooperation of the time sequence).

The light emitting element may include an organic light emitting diode, and may also include other light emitting devices.

In actual operation, when the light emitting element includes an organic light emitting diode, a first end of the light emitting element is a cathode of the organic light emitting diode, and a second end of the light emitting element is an anode of the organic light emitting diode.

In actual operation, the DC voltage input end may be ground, or may be another terminal that inputs a DC voltage.

As shown in FIG. 1, the pixel unit circuit of some embodiments of the present disclosure includes: an organic light emitting diode OLED, a cathode of the OLED being connected to a low level input end inputting a low level Vss; a storage capacitor sub-circuit 11, a first end of the storage capacitor sub-circuit being connected to a DC voltage input end VD; a driving transistor DTFT, a gate electrode of the driving transistor being connected to the second end of the storage capacitor sub-circuit 11, and a source electrode of the driving transistor being connected to an anode of the organic light emitting diode OLED; a light emitting control sub-circuit 12, a control end of the light emitting control sub-circuit 12 being connected to the light emitting control line EM, the first end of the light emitting control sub-circuit 12 being connected to a high-level input end inputting a high-level Vdd, and the second end of the light emitting control sub-circuit 12 being connected to the drain electrode of the driving transistor DTFT, configured to control whether the drain electrode of the driving transistor DTFT is connected to the high level input end inputting the high level Vdd under the control of the light emitting control line EM; and a charging compensation control sub-circuit 13, connected to a gate line Gate, a data line Data, and the gate electrode of the driving transistor DTFT, respectively, and configured to control whether the gate electrode of the driving transistor DTFT is connected to the data line Data under the control of the gate line Gate.

In the embodiment shown in FIG. 1, the driving transistor DTFT is an n-type transistor as an example. In actual operation, the driving transistor DTFT may also be a p-type transistor.

The pixel unit circuit shown in FIG. 1 is operated in a charging compensation phase and a pixel light emitting phase.

In the charging compensation phase, under the control of the light emitting control line EM, the light emitting control sub-circuit 12 controls the drain electrode of the driving transistor DTFT to be connected to the high level input end inputting the high level Vdd; under the control of the gate line Gate, the charging compensation control sub-circuit 13 controls the data voltage Vdata on the data line Data to be written to the gate electrode of the driving transistor DTFT such that the driving transistor DTFT is turned on until the potential at the source electrode of the driving transistor DTFT becomes Vdata-Vth, the driving transistor DTFT operates in a constant current region, Vth is a threshold voltage of the driving transistor DTFT.

In the pixel light emitting phase, under the control of the light emitting control line EM, the light emitting control sub-circuit 12 controls the drain electrode of the driving transistor DTFT to be connected to the high level input end inputting the high level Vdd, and the driving transistor DTFT operates in a constant current region. The OLED is driven to emit light.

In some embodiments, the pixel unit circuit further includes: a reset sub-circuit, respectively connected to the light emitting control line, the first electrode of the driving transistor, and a reset voltage input end, and configured to control, under the control of the light emitting control line, whether the first electrode of the driving transistor is connected to the reset voltage input end (i.e., controlling whether the first electrode of the driving transistor is electrically connected to the reset voltage input end, so as to control whether the first electrode of the drive transistor receives a signal from the reset voltage input), the reset voltage input end includes a ground or a low level input end.

The reset sub-circuit in the pixel unit circuit can eliminate the voltage remained in the anode of the OLED in a previous frame during the reset phase, thereby eliminating dynamic image sticking.

Figure 2:
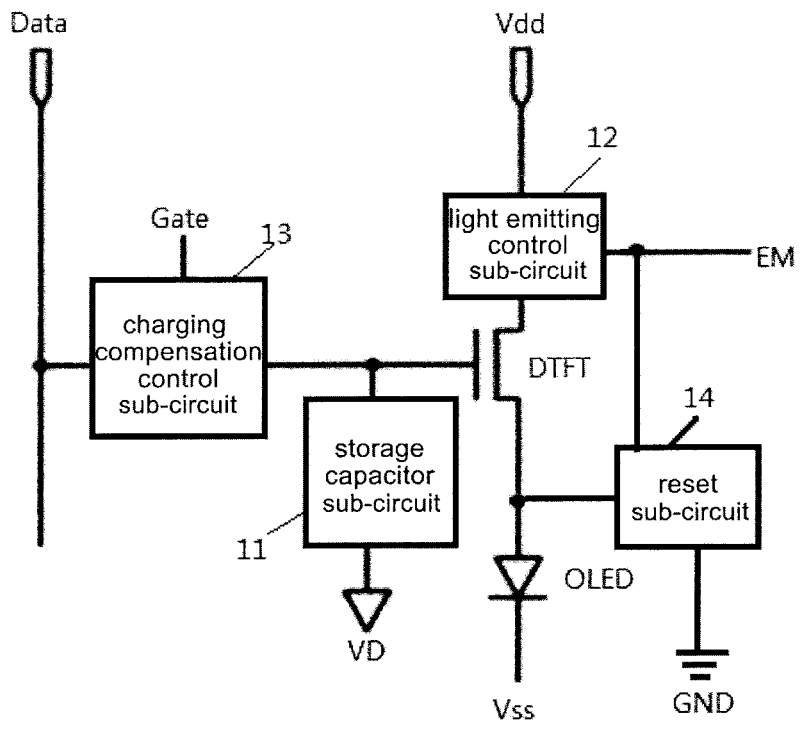
FIG. 2 is a structural diagram of a pixel unit circuit according to some embodiments of the present disclosure.

As shown in FIG. 2, on the basis of the pixel unit circuit shown in FIG. 1, the pixel unit circuit further includes: a reset sub-circuit 14, connected to the light emitting control line EM, the source electrode of the driving transistor DTFT and the ground GND, and configured to control whether the source electrode of the driving transistor DTFT is connected to the ground GND under the control of the light emitting control line EM (i.e., controlling whether the source electrode of the driving transistor DTFT is electrically connected to the ground GND, so as to control whether the source electrode of the driving transistor DTFT receives a signal from the ground GND).

When a pixel unit circuit shown in FIG. 2 is operated, a reset phase is further provided before the charge compensation phase.

In the reset phase, under the control of the light emitting control line EM, the reset sub-circuit 14 controls the source electrode of the driving transistor DTFT to be connected to the ground GND, so as to reset the potential at the source electrode of the driving transistor DTFT. The problem of dynamic afterimages in a high frequency is effectively improved.

In a specific implementation, in the charging compensation phase and the pixel light emitting phase, under the control of the light emitting control line EM, the reset sub-circuit 14 controls to disconnect the connection between the source electrode of the driving transistor and the ground GND.

Specifically, the reset sub-circuit may include: a reset switch transistor, a gate electrode of the reset switch transistor being connected to the light emitting control line, a first electrode of the reset switch transistor being connected to the first electrode of the driving transistor, a second electrode of the reset switch transistor being connected to the reset voltage input end.

Specifically, the light emitting control sub-circuit may include: a light emitting control transistor, a gate electrode of the light emitting control transistor being connected to the light emitting control line, the first electrode of the light emitting control transistor being connected to the high level input end, and the second electrode of the light emitting control transistor being connected to the second electrode of the driving transistor.

When the light emitting control transistor is a p-type transistor, the reset switch transistor is an n-type transistor. When the light emitting control transistor is an n-type transistor, the reset switch transistor is a p-type transistor.

According to some embodiments, on the basis of the pixel unit circuit shown in FIG. 1, the pixel unit circuit may further include: a potential control transistor, a gate electrode and a first electrode of the potential control transistor being connected to the first electrode of the driving transistor, the second electrode of the potential control transistor being grounded; the potential control transistor is a p-type transistor.

Figure 3:
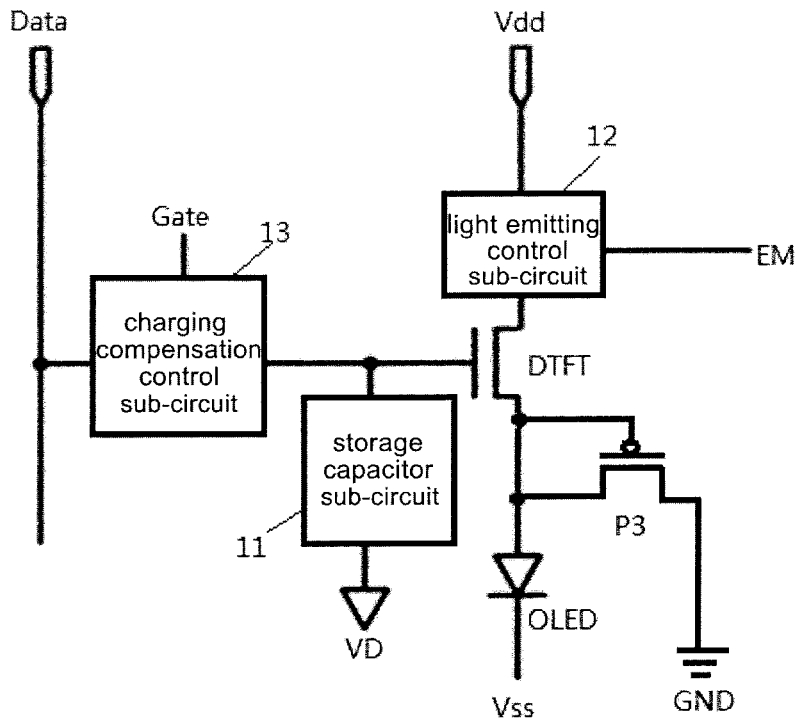
FIG. 3 is a structural diagram of a pixel unit circuit according to some embodiments of the present disclosure.

As shown in FIG. 3, on the basis of the pixel unit circuit shown in FIG. 1, the pixel unit circuit according to some embodiments of the present disclosure may further include: a potential control transistor P3, a gate electrode and a source electrode of the potential control transistor P3 being connected to the source electrode of the driving transistor DTFT, the drain electrode of the potential control transistor P3 being connected to the ground GND, and the potential control transistor P3 is a p-type transistor.

In the pixel unit circuit shown in FIG. 3, the potential control transistor P3 can effectively protect the anode potential of the OLED from being lower than the voltage outputted from the ground GND, thereby protecting the gate-source voltage of the DTFT does not exceed the maximum drive voltage of the gate-source voltage DTFT itself.

Figure 4:
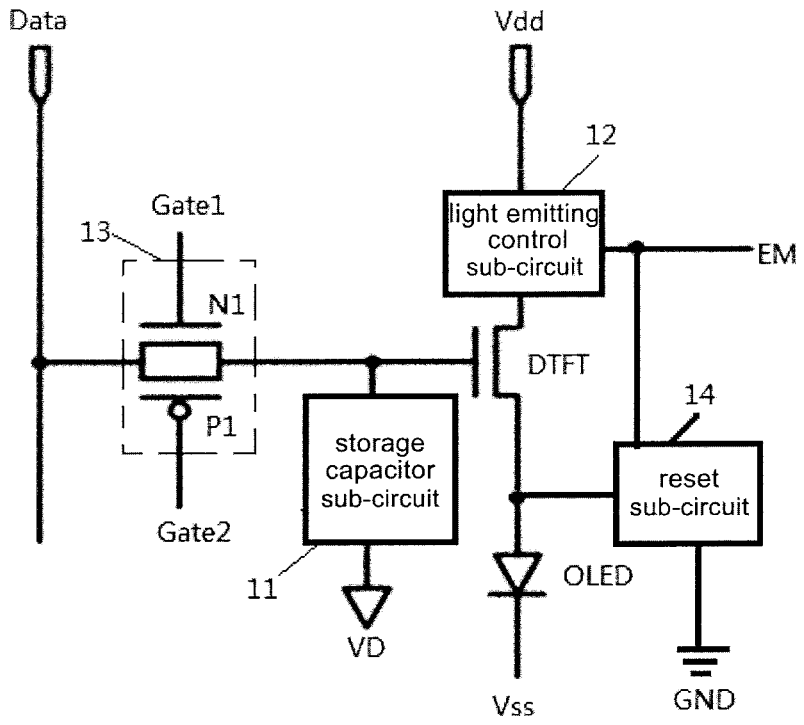
FIG. 4 is a structural diagram of a pixel unit circuit according to some embodiments of the present disclosure.

In a specific implementation, as shown in FIG. 4, the gate line may include a first gate switch line Gate1 and a second gate switch line Gate2.

The charging compensation control sub-circuit 13 includes: a first charge compensation control transistor N1, a gate electrode of the first charge compensation control transistor N1 being connected to the first gate switch line Gate1, a source electrode of the first charge compensation control transistor N1 being connected to a gate electrode of the drive transistor DTFT, and a drain electrode of the first charge compensation control transistor N1 being connected to the data line Data; and a second charge compensation control transistor P1, a gate electrode of the second charge compensation control transistor P1 being connected to the second gate switch line Gate2, a source electrode of the second charge compensation control transistor P1 being connected to the data line Data, and a drain electrode of the second charge compensation control transistor P1 being connected to a gate electrode of the drive transistor DTFT. The first charge compensation control transistor N1 is an n-type transistor, and the second charge compensation control transistor P1 is a p-type transistor.

In the embodiment of the pixel unit circuit shown in FIG. 4, the charge compensation control sub-circuit includes an NMOS transistor (Negative channel Metal Oxide Semiconductor) and a PMOS transistor (Positive channel Metal Oxide Semiconductor), a range of the data voltage on the data line may be increased and the brightness of the OLED may be improved.

In the embodiment shown in FIG. 4, if the charge compensation control sub-circuit includes only a first charge compensation control transistor N1, when the potential of the signal from Gate1 is not high enough, the data voltage from Data may not be transmitted to the gate electrode of the drive transistor DTFT. The charge compensation control sub-circuit of the pixel unit circuit shown in FIG. 4 further includes a second charge compensation control transistor P1, and Gate2 outputs a low level signal during the charge compensation phase, even if the data voltage from Data is relatively large, the data voltage can be written to the gate electrode of the driving transistor DTFT, so that the range of the effective driving voltage from the data line can be increased.

In actual operation, the storage capacitor sub-circuit may include a storage capacitor.

The pixel unit circuit of the present disclosure will be described by the following embodiments.

Figure 5:
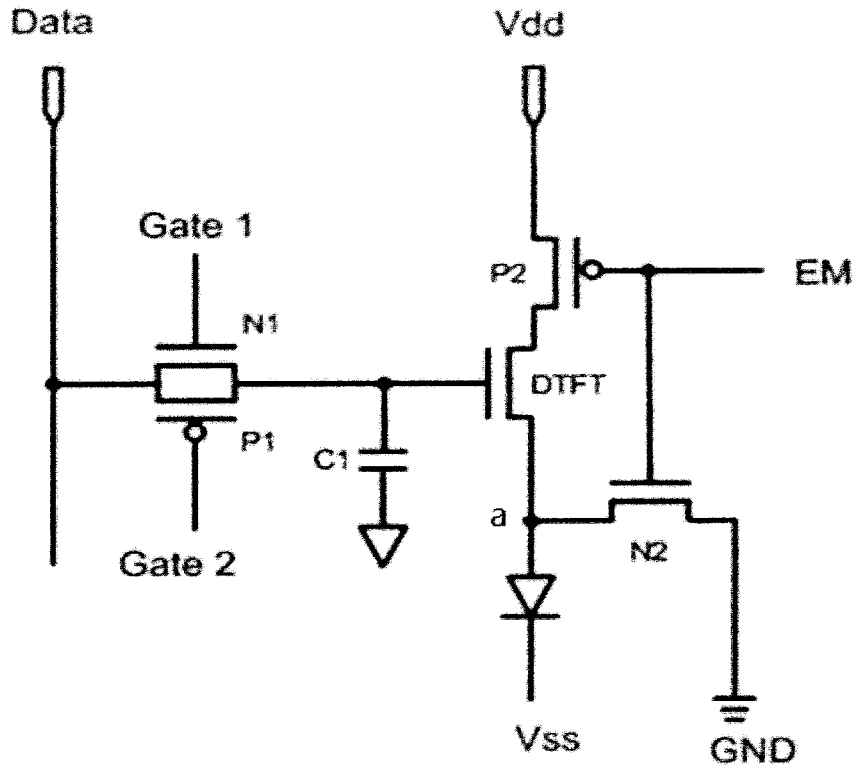
FIG. 5 is a circuit diagram of a pixel unit circuit of the present according to some embodiments of the present disclosure.

As shown in FIG. 5, the pixel unit circuit includes an organic light emitting diode (OLED), a storage capacitor CL a driving transistor DTFT, a light emitting control sub-circuit, a charge compensation control sub-circuit, and a reset sub-circuit.

An anode of the OLED is connected to a drain electrode of the driving transistor DTFT, and a cathode of the OLED is connected to a low level input end inputting a low level Vss.

A first end of the storage capacitor C1 is connected to a DC voltage input end VD, and a second end of the storage capacitor C1 is connected to the gate electrode of the driving transistor DTFT;

The source electrode of the driving transistor DTFT is connected to the anode of the OLED.

The charging compensation control sub-circuit includes: a first charge compensation control transistor N1, a gate electrode of the first charge compensation control transistor N1 being connected to the first gate switch line Gate1, a source electrode of the first charge compensation control transistor N1 being connected to the gate electrode of the drive transistor DTFT, and the drain electrode of the first charge compensation control transistor N1 being connected to the data line Data; and a second charge compensation control transistor P1, a gate electrode of the second charge compensation control transistor P1 being connected to a second gate switch line Gate2, a source electrode of the second charge compensation control transistor P1 being connected to the data line Data, and a drain electrode of the second charge compensation control transistor P1 being connected to a gate electrode of the drive transistor DTFT.

The reset sub-circuit includes: a reset switch transistor N2, a gate electrode of the reset switch transistor N2 being connected to the light emitting control line EM, a source electrode of the reset switch transistor N2 being connected to a source electrode of the driving transistor DTFT, and a drain electrode of the reset switch transistor N2 being connected to a ground GND;

The light emitting control sub-circuit includes: an light emitting control transistor P2, a gate electrode of the light emitting control transistor P2 being connected to the light emitting control line EM, a source electrode of the light emitting control transistor P2 being connected to a high level input end inputting a high level Vdd, and a drain electrode of the light emitting control transistor P2 being connected to a drain electrode of the driving transistor DTFT.

The first charge compensation control transistor N1 is an n-type transistor, the second charge compensation control transistor P1 is a p-type transistor, the reset switch transistor N2 is an n-type transistor, and the light emitting control transistor P2 is a p-type transistor. The driving transistor DTFT is an n-type transistor.

In FIG. 5, a is a node connected to the anode of the OLED.

Figure 6:
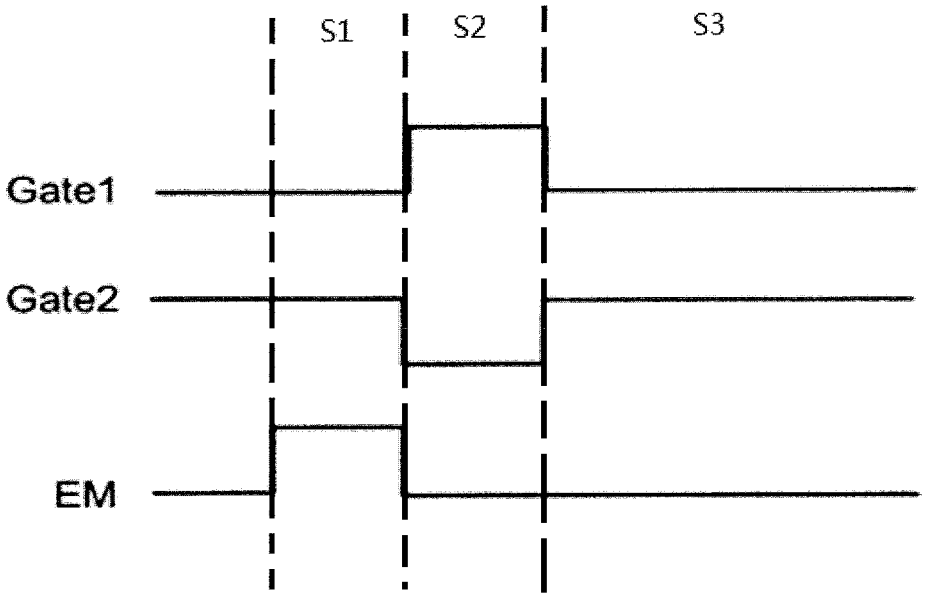
FIG. 6 is a timing sequence chart showing the operation of the pixel unit circuit shown in FIG. 5 according to some embodiments of the present disclosure.

FIG. 6 shows the operation of the pixel unit circuit shown in FIG. 5.

Figure 7A:
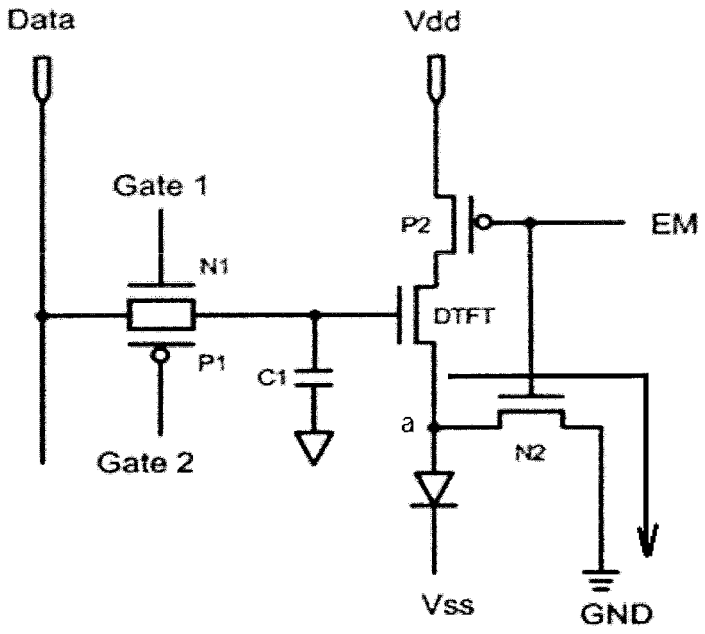
FIG. 7A is a schematic view showing the operation of the pixel unit circuit shown in FIG. 5 in the reset phase.

In the reset phase S1, Gate1 outputs a low level, and Gate2 and EM output a high level. As shown in FIG. 7A, N2 is turned on, P1, P2, and N1 are turned off, and the potential at node a is reset and discharged to a low level. Resetting the voltage signal of the anode OLED in the previous frame can effectively improve the problem of dynamic image sticking in a high frequency.

Figure 7B:
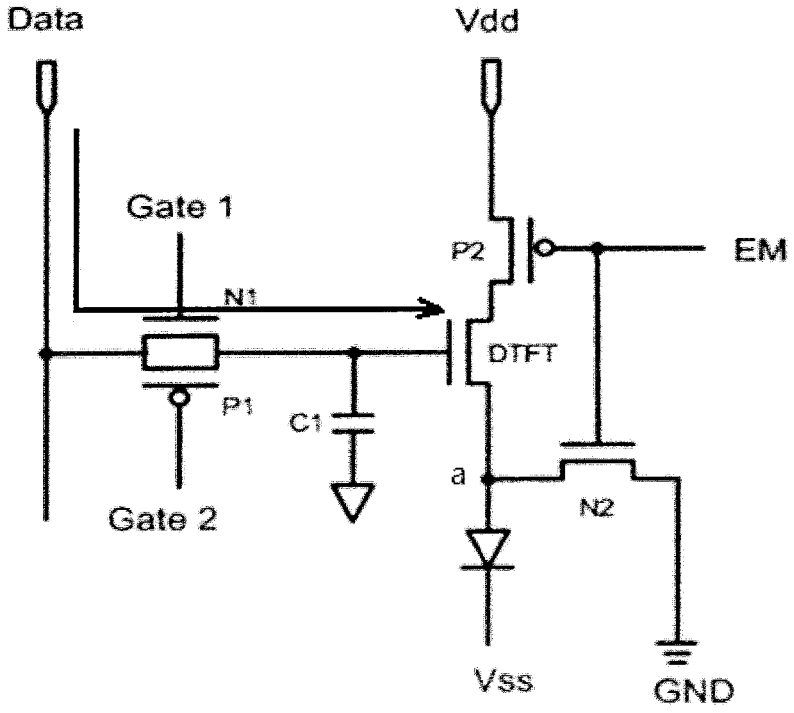
FIG. 7B is a schematic diagram showing the operation of the pixel unit circuit shown in FIG. 5 in the charging compensation phase.

In the charge compensation phase S2, Gate1 outputs a high level, and Gate2 and EM both output a low level. As shown in FIG. 7B, P1, P2, and N1 are both turned on, N2 is turned off, the gate electrode of DTFT is charged by the data voltage Vdata from the Data through C1, the potential between two ends of C1 is charged to Vdata, the DTFT is turned on until the potential at a node becomes Vdata-Vth, and the DTFT operates in a constant current region (or an approximate constant current region); N1 and P1 are adopted so as to increase a range of the effective driving voltage from the Data.

Figure 7C:
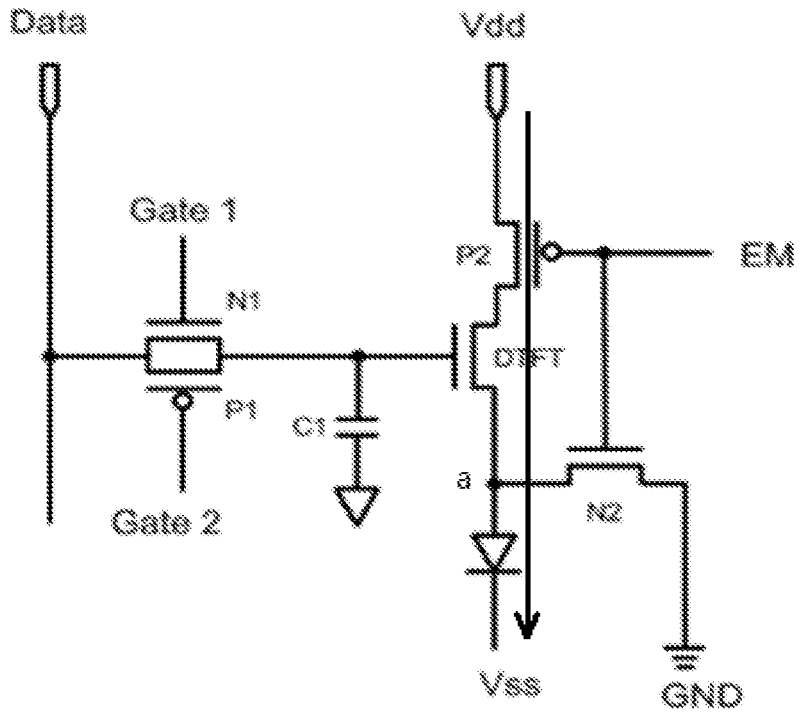
FIG. 7C is a schematic diagram showing the operation of the pixel unit circuit shown in FIG. 5 in the pixel light emitting stage.

In the pixel light emitting phase S3, Gate1 and EM both output a low level, and Gate2 outputs a high level. As shown in FIG. 7C, P2 is turned on, N1, P1, and N2 are all turned off, and a potential at node a is maintained at Vdata-Vth. When the drain electrode of the DTFT receives Vdd, DTFT operates in a constant current region (or an approximate constant current region), and OLED is driven to emit light by a current passing through P2 that is turned on and the DTFT in the constant current region. The pixel unit circuit controls the potential at the gate electrode of the driving transistor DTFT, so as to change the potential at node a, thereby changing the voltage across the OLED and changing the light emitting current of the OLED.

In a specific implementation, the pixel unit circuit may be disposed on a silicon substrate, and the light emitting element included in the pixel unit circuit may be an organic light emitting diode. A silicon-based OLED (organic light emitting diode) design is provided in the present disclosure. The pixel drive circuit design can match the new timing sequence so as to effectively adjust the brightness of the Micro (micro) OLED itself, and improve the dynamic image sticking problem. In addition, for the pixel unit circuit itself, a range of the data voltage is increased through the gate electrode of a special TFT, and the brightness of the OLED is electively increased.

Figure 8:
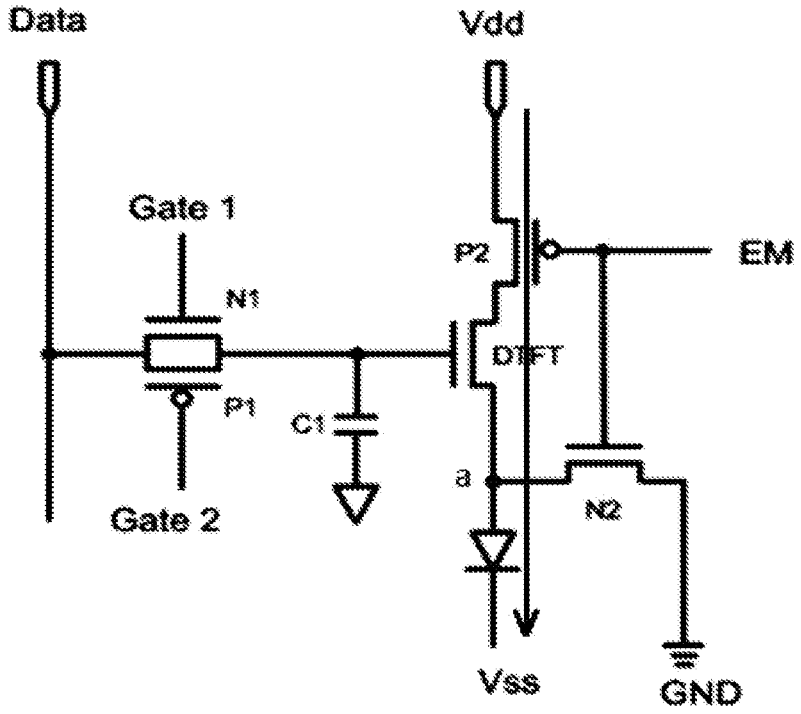
FIG. 8 is a circuit diagram of a pixel unit circuit according to some embodiments of the present disclosure.

As shown in FIG. 8, the pixel unit circuit includes an organic light emitting diode OLED, a storage capacitor C1, a driving transistor DTFT, a light emitting control sub-circuit, a charge compensation control sub-circuit, and a potential control transistor P3.

The anode of the OLED is connected to the drain electrode of the driving transistor DTFT, and the cathode of the OLED is connected to the low level input end inputting the low level Vss.

The first end of the storage capacitor C1 is connected to the DC voltage input end VD, and the second end of the storage capacitor C1 is connected to the gate electrode of the driving transistor DTFT. The source electrode of the driving transistor DTFT is connected to an anode of the OLED.

The charging compensation control sub-circuit includes: a first charge compensation control transistor N1, a gate electrode of the first charge compensation control transistor N1 being connected to the first gate switch line Gate1, a source electrode of the first charge compensation control transistor N1 being connected to a gate electrode of the drive transistor DTFT, and a drain electrode of the first charge compensation control transistor N1 being connected to the data line Data; and a second charge compensation control transistor P1, a gate electrode of the second charge compensation control transistor P1 being connected to the second gate switch line Gate2, a source electrode of the second charge compensation control transistor P1 being connected to the data line Data, and a drain electrode of the second charge compensation control transistor P1 being connected to a gate electrode of the drive transistor DTFT.

The light emitting control sub-circuit includes: a light emitting control transistor P2, a gate electrode of the light emitting control transistor P2 being connected to the light emitting control line EM, a source electrode of the light emitting control transistor P2 being connected to a high level input end inputting the high level Vdd, and a drain electrode of the light emitting control transistor P2 being connected to a drain electrode of the driving transistor DTFT.

The gate electrode and the source electrode of the potential control transistor P3 are both connected to the source electrode of the driving transistor DTFT, and the drain electrode of the potential controlling transistor P3 is connected to the ground GND.

The potential control transistor P3 is a p-type transistor. The first charge compensation control transistor N1 is an n-type transistor, the second charge compensation control transistor P1 is a p-type transistor, the light emitting control transistor P2 is a p-type transistor, and the drive transistor DTFT is an n-type transistor.

When the pixel unit circuit shown in FIG. 8 is in operation, the potential at the anode of the OLED can be effectively protected from being lower than the ground level by setting P3, thereby ensuring that the gate-source voltage of the DTFT does not exceed the maximum driving voltage of the DTFT.

A method driving the pixel unit circuit according to some embodiments of the present disclosure is used to drive the pixel unit circuit described above, and the driving method of the pixel unit circuit includes the following steps.

In the charging compensation phase, under the control of the light emitting control line, the light emitting control sub-circuit controls the second electrode of the driving transistor to be connected to the high level input end; under the control of the gate line, the charging compensation control sub-circuit controls the data voltage Vdata on the data line to be written to the gate electrode of the driving transistor, such that the driving transistor is turned on until a potential at the first electrode of the driving transistor becomes Vdata-Vth, the driving transistor operates in a constant current region; Vth is a threshold voltage of the driving transistor.

In the pixel light emitting phase, under the control of the light emitting control line, the light emitting control sub-circuit controls the second electrode of the driving transistor to be connected to the high level input end, and the driving transistor operates in a constant current region to drive the light emitting element to emit light.

Optionally, when the pixel unit circuit further includes a reset sub-circuit, respectively connected to the light emitting control line, the first electrode of the driving transistor, and the reset voltage input end, configured to control whether the first electrode of the driving transistor is connected to the reset voltage input end under the control of the light emitting control line; when the reset voltage input end includes a ground end or a low level input end, the method for driving the pixel unit circuit further includes the following step before the charging compensation phase.

In the reset phase, under the control of the light emitting control line, the reset sub-circuit controls the first electrode of the drive transistor to be connected to the reset voltage input end, so as to reset the potential at the first electrode of the drive transistor.

Figure 15:
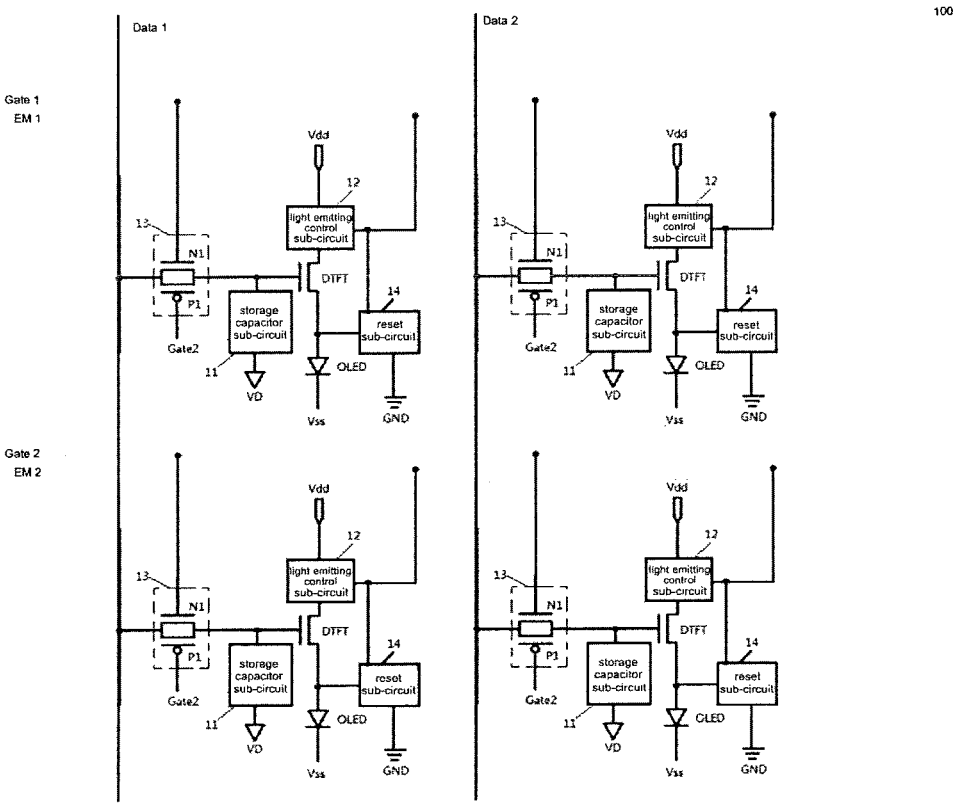
FIG. 15 is a schematic structural diagram of a pixel circuit according to some embodiments of the present disclosure.

The pixel circuit of some embodiments of the present disclosure, as shown in FIG. 15, includes a plurality of gate lines, a plurality of data lines, a plurality of light emitting control lines, and a plurality of the pixel unit circuits arranged in an array form. Pixel unit circuits located in the same row are connected to a same gate lines. Pixel unit circuits in the same column are connected to a same data line.

When the pixel unit circuit further includes a reset sub-circuit, the pixel unit circuits located in the same row are connected to a same light emitting control line.

In a specific implementation, the pixel circuit described in the embodiment of the present disclosure may be disposed on the silicon substrate 100.

The method for driving the pixel circuit is used to drive the pixel circuit described above, and within one display frame time, one row of pixel unit circuits corresponds to a corresponding charging compensation phase and a corresponding pixel lighting phase.

The method for driving the pixel circuit includes the corresponding charging compensation phase and the corresponding pixel light emitting stage within a display frame time.

In the corresponding charging compensation phase, under the control of the corresponding light emitting control line, the light emitting control sub-circuits of the pixel unit circuits in the corresponding row control the second electrodes of the driving transistors to be connected to the high level input end; the charge compensation control sub-circuits of the pixel unit circuits in the corresponding row control the data voltage Vdata of the corresponding data line to be written to the gate electrodes of the driving transistors included in the pixel unit circuits in the corresponding row, so that the driving transistors are turned on until the potential at the first electrodes of the driving transistors becomes Vdata-Vth, the driving transistors operate in a constant current region; Vth is a threshold voltage of the driving transistor.

In the corresponding pixel light emitting stage, under the control of the corresponding light emitting control line, the light emitting control sub-circuits control the second electrodes of the driving transistors to be connected to the high level input end, and the driving transistors operate in a constant current region. The light emitting elements are driven to emit light.

Optionally, the pixel unit circuit in the pixel circuit includes a reset sub-circuit, and is respectively connected to the light emitting control line, the first electrode of the driving transistor, and the reset voltage input end, configured to control whether a first electrode of the driving transistor is connected to the reset voltage input end under the control of the light emitting control line; and the reset voltage input end includes a ground end or a low level input end, a full-screen black insertion period is set between two adjacent display frames.

The driving method of the pixel circuit further includes: in the full-screen black insertion period, all light emitting control lines included in the pixel circuit output a first level signal, so that the second ends of the light emitting elements in each pixel unit circuit included in the pixel circuit are all connected to the reset voltage input end, so that the potentials of second ends of the light emitting elements in each pixel unit circuit included in the pixel circuit are reset within a full-screen black insertion period between adjacent two frame display periods, so as to improve dynamic image sticking.

In actual operation, the light emitting element may include an organic light emitting diode, and the second end of the light emitting element may be an anode of the organic light emitting diode.

In actual operation, when the light emitting control transistor included in the light emitting control sub-circuit is an n-type transistor, the first level signal is a high level signal, and when the light emitting control transistor is a p-type transistor, the first level signal is a low level signal. The following is an example in which the light emitting control transistor included in the light emitting control sub-circuit is an n-type transistor.

Figure 9:
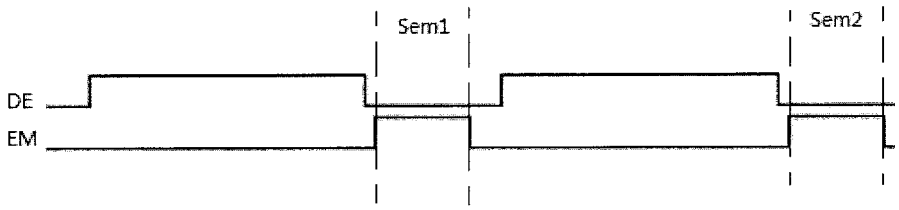
FIG. 9 is a timing sequence diagram of operation of the pixel circuit in a full screen black insertion mode according to some embodiments of the present disclosure.

As shown in FIG. 9, a data enable signal is labeled as DE. When DE is a high level, the pixel circuit is within one frame display time. When DE is a low level, the pixel circuit is in a blank time period. The light emitting control line is labeled as EM. EM outputs a low-level signal within a frame display time, and the EM outputs a high-level signal in a full-screen black insertion period between adjacent two display frames, and a potential at the second end of the light emitting element is reset to improve the dynamic image sticking phenomenon. In FIG. 9, a first full-screen black insertion period is labeled as Sem1, and the second full-screen black insertion period is labeled as Sem2.

Optionally, when the pixel unit circuit in the pixel circuit includes a reset sub-circuit, connected to the light emitting control line, the first electrode of the driving transistor, and the reset voltage input end, respectively, and configured to control whether the first electrode of the driving transistor is connected to the reset voltage input end under the control of the light emitting control line; and when the reset voltage input end includes a ground end or a low level input end, a plurality of full-screen black insertion periods are alternately set within one display frame time; the driving method of the pixel circuit further includes the following steps.

In the full-screen black insertion period, all the light emitting control lines included in the pixel circuit output a first level signal, so that the second end of the light emitting element of each pixel unit circuit included in the pixel circuit are connected to the reset voltage input end.

In actual operation, when the light emitting control transistor included in the light emitting control sub-circuit is an n-type transistor, the first level signal is a high level signal, and when the light emitting control transistor is a p-type transistor, the first level signal is a low level signal. The following is an example in which the light emitting control transistor included in the light emitting control sub-circuit is an n-type transistor.

Figure 10:
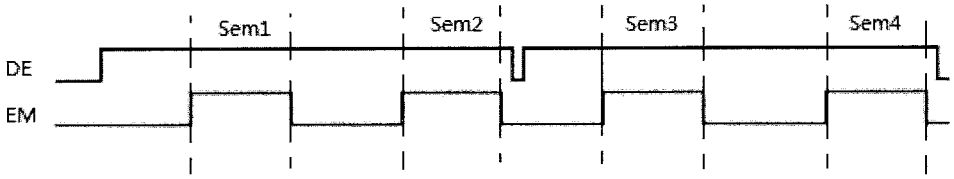
FIG. 10 is another timing sequence diagram of the pixel circuit in a full screen black insertion mode according to some embodiments of the present disclosure.

As shown in FIG. 10, the data enable signal is labeled as DE. When DE is a high level, the pixel circuit is within one frame display time. When DE is a low level, the pixel circuit is in a blank time period. The light emitting control line is labeled as EM, two full-screen black insertion periods are set in one frame display time. In the full-screen black insertion period, the EM outputs a high-level signal, and the potential at the second end of the light emitting element is reset so as to improve the dynamic image sticking phenomenon; the EM outputs a low level signal in time periods other than the full screen black insertion period.

In FIG. 10, the first full-screen black insertion period is labeled as Sem1, the second full-screen black insertion period is labeled as Sem2, and the third full-screen black insertion period is labeled as Sem3, and the fourth full-screen insertion black time period is labeled as Sem4.

In an alternative embodiment as shown in FIG. 9, the full-screen black insertion mode is entered after one frame display time is ended, thereby effectively improving the dynamic image sticking phenomenon. In the alternative embodiment shown in FIG. 10, within one display frame time, the full screen black insertion mode is implemented for multiple times, thereby effectively improving the dynamic image sticking phenomenon.

Optionally, when the pixel unit circuit in the pixel circuit includes a reset sub-circuit, respectively connected to the light emitting control line, the first electrode of the driving transistor, and the reset voltage input end, and configured to control whether the first electrode of the driving transistor is connected to the reset voltage input end under the control of the light emitting control line; and when the reset voltage input end includes a ground end or a low level, the method for driving the pixel circuit includes: within one display frame time, the plurality of light emitting control lines included in the pixel circuit sequentially output a first level signal, so that the second ends of the light emitting elements in the plurality of pixel unit circuits included in the pixel circuit are sequentially connected to the reset voltage input end, that is, within one display frame time, the plurality of light emitting control lines is controlled to sequentially output the first level signal from top to bottom, thereby implementing black insertion progressively, that is, potentials at the second ends of the light emitting elements of the plurality rows of pixel unit circuits included in the pixel circuit are reset progressively in order to improve dynamic image sticking.

Optionally, when the pixel unit circuit included in the pixel circuit includes a reset sub-circuit, respectively connected to the light emitting control line, the first electrode of the driving transistor, and the reset voltage input end, and configured to control whether the first electrode of the driving transistor is connected to the reset voltage input end under the control of the light emitting control line; when the reset voltage input end includes a ground end or a low level input end, one display frame time includes at least two display periods, the method for driving the pixel circuit further includes: in each display period, the plurality of light emitting control lines included in the pixel circuit sequentially output a first level signal, so that the second ends of the light emitting elements in the plurality rows of pixel unit circuits included in the pixel circuit are sequentially connected to the reset voltage input end. That is, the one display frame time includes at least two display periods. Within one display period, the plurality of light emitting control lines is controlled to sequentially output the first level signal from top to bottom, thereby implementing black insertion progressively, that is, the potentials of the second ends of the light emitting elements of the plurality rows of pixel unit circuit included in the pixel circuit are sequentially reset to improve the dynamic image sticking phenomenon. In this alternative embodiment, within one display frame time, black insertion is performed progressively.

In actual operation, when the light emitting control transistor included in the light emitting control sub-circuit is an n-type transistor, the first level signal is a high level signal, and when the light emitting control transistor is a p-type transistor, the first level signal is a low level signal. The following is an example in which the light emitting control transistor included in the light emitting control sub-circuit is an n-type transistor.

Figure 11:
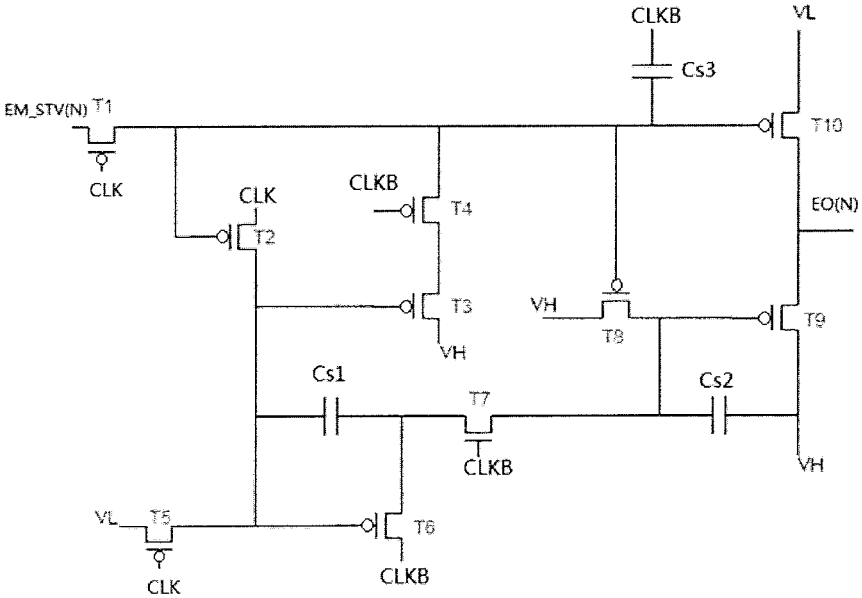
FIG. 11 is a circuit diagram of a shift register unit that generates an light emitting control signal according to some embodiments of the present disclosure.

FIG. 11 is a circuit diagram of a shift register unit that generates a light emitting control signal according to some embodiments of the present disclosure.

As shown in FIG. 11, the shift register unit includes: a first transistor T1, a second transistor T2, a third transistor T3, a fourth transistor T4, a fifth transistor T5, a sixth transistor T6, a seventh transistor T7, eighth transistor T8, ninth transistor T9, tenth transistor T10, first capacitor Cs1, second capacitor Cs2 and third capacitor Cs3; the first clock signal labeled as CLK, the second clock signal labeled as CLKB, a low level labeled as VL, a high level labeled as VH, Nth-level light emitting control signal labeled as EO(N), and Nth-level start signal labeled as EM_STV(N); N is an integer greater than one. In actual operation, EM_STV(N) is EO(N−1). In the embodiment shown in FIG. 11, all of the transistors are p-type transistors. In actual operation, the above transistors can also be replaced with n-type transistors, and only the timing sequences of the corresponding control signals needs to be changed.

Figure 12:
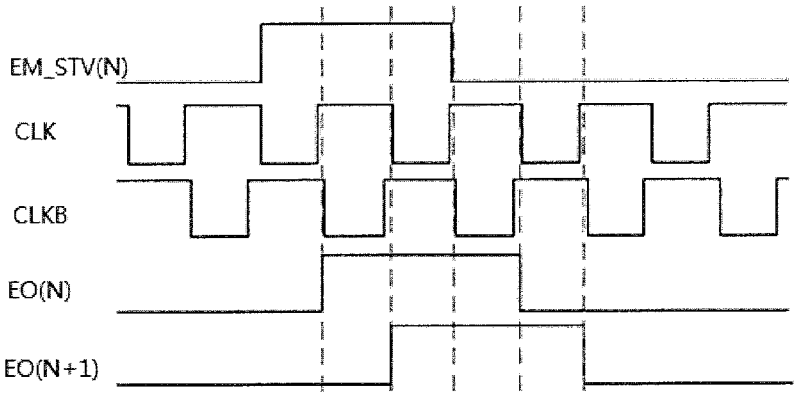
FIG. 12 is a timing sequence diagram showing the operation of the shift register unit shown in FIG. 11 according to some embodiments of the present disclosure.

FIG. 12 is a timing sequence diagram showing the operation of the shift register unit shown in FIG. 11 according to some embodiments of the present disclosure. In FIG. 12, EO(N+1) is the (N+1)th-level light emitting control signal.

As shown in FIG. 12, EO(N) and EO(N+1) are sequentially at a high level.

Figure 13:
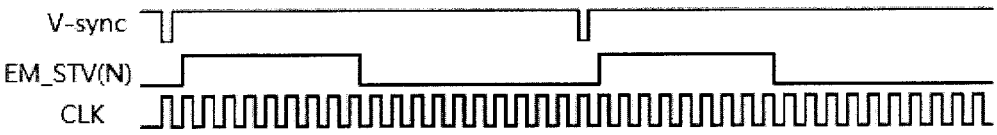
FIG. 13 is a timing sequence diagram showing an operation of a pixel circuit in a progressive black insertion mode of according to some embodiments of the present disclosure.

As shown in FIG. 13, V-sync is a synchronous refresh voltage. When V-sync is high, the pixel circuit is within one display frame time. When V-sync is low, the pixel circuit is within a blank time period; EM_STV(N) is Nth-level start signal, CLK is the first clock signal, as shown in the circuit in FIG. 11 and the timing sequence in FIG. 13, the plurality of light emitting control lines output a high level signal from top to bottom within one display frame time, so as to perform black insertion progressively.

Figure 14:
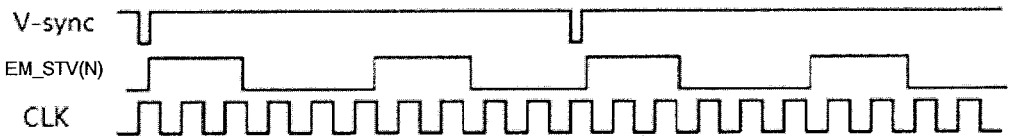
FIG. 14 is a timing sequence diagram showing another operation of the pixel circuit in a progressive black insertion mode of according to some embodiments of the present disclosure.

As shown in FIG. 14, V-sync is a synchronous refresh voltage. When V-sync is high, the pixel circuit is within one display frame time. When V-sync is low, the pixel circuit is within a blank time period; EM_STV(N) is the Nth-level start signal, CLK is the first clock signal, as shown in the circuit in FIG. 11 and the timing sequence in FIG. 14, the plurality of light emitting control lines outputs the high level signal at least twice from top to down within one display frame time, so as to perform black insertion progressively at least twice.

In a specific implementation, by controlling the duty ratio of EM_STV(N) and the duty ratio of CLK, the time length during which the corresponding light emitting control signal is at a high level can be controlled. The smaller the duty cycle of CLK is, the larger the range adjustable by the light emitting control signal is.

The display device according to the embodiment of the present disclosure, as shown in FIG. 15, includes a silicon substrate 100 and the above-described pixel unit circuit disposed on the silicon substrate.

In actual operation, the display device according to the embodiment of the present disclosure further includes a plurality of gate lines, a plurality of data lines, and a plurality light emitting control lines disposed on the silicon substrate.

The display device includes a plurality of the pixel unit circuits arranged on the silicon substrate in an array form.

Pixel unit circuits located in a same row are connected to a same gate line; pixel unit circuits in the same column are connected to a same data line.

When the pixel unit circuit includes a reset sub-circuit, pixel unit circuits located in the same column are connected to the same light emitting control line.

The above is some embodiments of the present disclosure, and those skilled in the art can also make improvements and modification without departing from the principles of the present disclosure. The improvements and modification should also be within the protection scope of the present disclosure.

What is claimed is:

1. A pixel unit circuit, comprising:

a light emitting element, a first end of the light emitting element being connected to a low level input end;

a storage capacitor sub-circuit, a first end of the storage capacitor sub-circuit being connected to a DC voltage input end;

a driving transistor, a gate electrode of the driving transistor being connected to a second end of the storage capacitor sub-circuit, and a first electrode of the driving transistor being directly connected to a second end of the light emitting element;

a light emitting control sub-circuit, a control end of the light emitting control sub-circuit being connected to a light emitting control line, the first end of the light emitting control sub-circuit being connected to a high level input end, and the second end of the light emitting control sub-circuit being connected to a second electrode of the driving transistor, and configured to control whether the second electrode of the driving transistor receives a signal from the high level input end under the control of the light emitting control line;

a charge compensation control sub-circuit, connected to a gate line, a data line and the gate electrode of the driving transistor, and configured to control whether the gate electrode of the driving transistor directly receives a signal from the data line under the control of the gate line; and a reset sub-circuit, connected to the light emitting control line, the first electrode of the driving transistor, and a reset voltage input end, and configured to control whether the first electrode of the driving transistor receives a signal from the reset voltage input end under the control of the light emitting control line, wherein the reset sub-circuit comprises a reset switch transistor, a gate electrode of the reset switch transistor is connected to the light emitting control line, a first electrode of the reset switch transistor is connected to the first electrode of the driving transistor, a second electrode of the reset switch transistor is connected to the reset voltage input end;

the light emitting control sub-circuit includes a light emitting control transistor, a gate electrode of the light emitting control transistor is connected to the light emitting control line, the first electrode of the light emitting control transistor is connected to the high level input end, and the second electrode of the light emitting control transistor is connected to the second electrode of the driving transistor, the light emitting control transistor is a p-type transistor and the reset switch transistor is an n-type transistor, or the light emitting control transistor is an n-type transistor and the reset switch transistor is a p-type transistor, wherein the pixel unit circuit further comprises a potential control transistor, a gate electrode and a first electrode of the potential control transistor is connected to the first electrode of the driving transistor, the second electrode of the potential control transistor is directly connected to ground; the potential control transistor is a p-type transistor, the gate line comprises a first gate switch line and a second gate switch line;

the charging compensation control sub-circuit comprises:

a first charge compensation control transistor, a gate electrode of the first charge compensation control transistor being connected to the first gate switch line, a first electrode of the first charge compensation control transistor being connected to a gate electrode of the drive transistor, and a second electrode of the first charge compensation control transistor being connected to the data line; and a second charge compensation control transistor, a gate electrode of the second charge compensation control transistor being connected to the second gate switch line, a first electrode of the second charge compensation control transistor being connected to the data line, and a second electrode of the second charge compensation control transistor being connected to a gate electrode of the drive transistor; and the first charge compensation control transistor is an n-type transistor, and the second charge compensation control transistor is a p-type transistor.

2. A method for driving a pixel unit circuit, wherein the pixel unit circuit comprises a light emitting element, a first end of the light emitting element being connected to a low level input end;

a storage capacitor sub-circuit, a first end of the storage capacitor sub-circuit being connected to a DC voltage input end;

a driving transistor, a gate electrode of the driving transistor being connected to a second end of the storage capacitor sub-circuit, and a first electrode of the driving transistor being directly connected to a second end of the light emitting element;

a light emitting control sub-circuit, a control end of the light emitting control sub-circuit being connected to a light emitting control line, the first end of the light emitting control sub-circuit being connected to a high level input end, and the second end of the light emitting control sub-circuit being connected to a second electrode of the driving transistor, and configured to control whether the second electrode of the driving transistor receives a signal from the high level input end under the control of the light emitting control line;

a charge compensation control sub-circuit, connected to a gate line, a data line and the gate electrode of the driving transistor, and configured to control whether the gate electrode of the driving transistor directly receives a signal from the data line under the control of the gate line; and a reset sub-circuit, connected to the light emitting control line, the first electrode of the driving transistor, and a reset voltage input end, and configured to control whether the first electrode of the driving transistor receives a signal from the reset voltage input end under the control of the light emitting control line, wherein the reset sub-circuit comprises a reset switch transistor, a gate electrode of the reset switch transistor is connected to the light emitting control line, a first electrode of the reset switch transistor is connected to the first electrode of the driving transistor, a second electrode of the reset switch transistor is connected to the reset voltage input end;

the light emitting control sub-circuit includes a light emitting control transistor, a gate electrode of the light emitting control transistor is connected to the light emitting control line, the first electrode of the light emitting control transistor is connected to the high level input end, and the second electrode of the light emitting control transistor is connected to the second electrode of the driving transistor, the light emitting control transistor is a p-type transistor and the reset switch transistor is an n-type transistor, or the light emitting control transistor is an n-type transistor and the reset switch transistor is a p-type transistor, wherein the pixel unit circuit further comprises a potential control transistor, a gate electrode and a first electrode of the potential control transistor is connected to the first electrode of the driving transistor, the second electrode of the potential control transistor is directly connected to ground; the potential control transistor is a p-type transistor, the gate line comprises a first gate switch line and a second gate switch line;

the charging compensation control sub-circuit comprises:

a first charge compensation control transistor, a gate electrode of the first charge compensation control transistor being connected to the first gate switch line, a first electrode of the first charge compensation control transistor being connected to a gate electrode of the drive transistor, and a second electrode of the first charge compensation control transistor being connected to the data line; and a second charge compensation control transistor, a gate electrode of the second charge compensation control transistor being connected to the second gate switch line, a first electrode of the second charge compensation control transistor being connected to the data line, and a second electrode of the second charge compensation control transistor being connected to a gate electrode of the drive transistor; and the first charge compensation control transistor is an n-type transistor, and the second charge compensation control transistor is a p-type transistor, wherein the method comprises:

in a charging compensation phase, under the control of a light emitting control line, controlling, by the light emitting control module, a second electrode of a driving transistor to receive a signal from a high level input end; under the control of a gate line, controlling, by a charging compensation control module, a data voltage Vdata on a data line to be written to a gate electrode of the driving transistor, such that the driving transistor is turned on until a potential at a first electrode of the driving transistor becomes Vdata-Vth, the driving transistor being operated in a constant current region; Vth being a threshold voltage of the driving transistor; and in a pixel light emitting phase, under the control of the light emitting control line, controlling, the light emitting control module, the second electrode of the driving transistor to receive a signal from the high level input end, and the driving transistor being operated in a constant current region to drive the light emitting element to emit light.

3. The method for driving the pixel unit circuit according to claim 2, wherein the reset voltage input end includes a ground end or a low level input end, before the charging compensation phase, the method for driving the pixel unit circuit further comprises:

in a reset phase, under the control of the light emitting control line, controlling, the reset module, the first electrode of the drive transistor to receive a signal from the reset voltage input end, to reset the potential at the first electrode of the drive transistor; and in the charging compensation phase and the pixel light emitting phase, under the control of the light emitting control line, controlling, the reset module, the first electrode of the drive transistor not to receive a signal from the reset voltage input end.

4. A pixel circuit, comprising a plurality of gate lines, a plurality of data lines, a plurality of light emitting control lines, and a plurality of pixel unit circuits according to claim 1, wherein the plurality of the pixel unit circuit are arranged in an array form, pixel unit circuits in a same row are connected to a same gate lines, pixel unit circuits in a same column are connected to a same data line.

5. The pixel circuit according to claim 4, wherein the pixel unit circuits in the same row are connected to a same light emitting control line.

6. The pixel circuit according to claim 5, wherein the reset voltage input end comprises a ground end or a low level input end.

7. A method for driving a pixel circuit, wherein the pixel circuit comprises a plurality of gate lines, a plurality of data lines, a plurality of light emitting control lines, and a plurality of pixel unit circuits, the plurality of the pixel unit circuit are arranged in an array form, pixel unit circuits in a same row are connected to a same gate lines, pixel unit circuits in a same column are connected to a same data line, the pixel unit circuit comprises:

a light emitting element, a first end of the light emitting element being connected to a low level input end;

a storage capacitor sub-circuit, a first end of the storage capacitor sub-circuit being connected to a DC voltage input end;

a driving transistor, a gate electrode of the driving transistor being connected to a second end of the storage capacitor sub-circuit, and a first electrode of the driving transistor being directly connected to a second end of the light emitting element;

a light emitting control sub-circuit, a control end of the light emitting control sub-circuit being connected to a light emitting control line, the first end of the light emitting control sub-circuit being connected to a high level input end, and the second end of the light emitting control sub-circuit being connected to a second electrode of the driving transistor, and configured to control whether the second electrode of the driving transistor directly receives a signal from the high level input end under the control of the light emitting control line;

a charge compensation control sub-circuit, connected to a gate line, a data line and the gate electrode of the driving transistor, and configured to control whether the gate electrode of the driving transistor receives a signal from the data line under the control of the gate line; and a reset sub-circuit, connected to the light emitting control line, the first electrode of the driving transistor, and a reset voltage input end, and configured to control whether the first electrode of the driving transistor receives a signal from the reset voltage input end under the control of the light emitting control line, wherein the reset sub-circuit comprises a reset switch transistor, a gate electrode of the reset switch transistor is connected to the light emitting control line, a first electrode of the reset switch transistor is connected to the first electrode of the driving transistor, a second electrode of the reset switch transistor is connected to the reset voltage input end;

the light emitting control sub-circuit includes a light emitting control transistor, a gate electrode of the light emitting control transistor is connected to the light emitting control line, the first electrode of the light emitting control transistor is connected to the high level input end, and the second electrode of the light emitting control transistor is connected to the second electrode of the driving transistor, the light emitting control transistor is a p-type transistor and the reset switch transistor is an n-type transistor, or the light emitting control transistor is an n-type transistor and the reset switch transistor is a p-type transistor, wherein the pixel unit circuit further comprises a potential control transistor, a gate electrode and a first electrode of the potential control transistor is connected to the first electrode of the driving transistor, the second electrode of the potential control transistor is directly connected to ground; the potential control transistor is a p-type transistor, the gate line comprises a first gate switch line and a second gate switch line;

the charging compensation control sub-circuit comprises:

a first charge compensation control transistor, a gate electrode of the first charge compensation control transistor being connected to the first gate switch line, a first electrode of the first charge compensation control transistor being connected to a gate electrode of the drive transistor, and a second electrode of the first charge compensation control transistor being connected to the data line; and a second charge compensation control transistor, a gate electrode of the second charge compensation control transistor being connected to the second gate switch line, a first electrode of the second charge compensation control transistor being connected to the data line, and a second electrode of the second charge compensation control transistor being connected to a gate electrode of the drive transistor; and the first charge compensation control transistor is an n-type transistor, and the second charge compensation control transistor is a p-type transistor, wherein within a display frame time, one row of pixel unit circuits corresponds to a corresponding charging compensation phase and a corresponding pixel light emitting phase;

within the display frame time, the method for driving the pixel circuit comprises:

in the corresponding charging compensation phase, under the control of a corresponding light emitting control line, controlling, by the light emitting control sub-circuits of the pixel unit circuits in a corresponding row, second electrodes of driving transistors to receive a signal from the high level input end; under the control of a corresponding gate line, controlling, by charge compensation control sub-circuits of the pixel unit circuits in the corresponding row, a data voltage Vdata of a corresponding data line to be written to gate electrodes of the driving transistors included in the pixel unit circuits in the corresponding row, so that the driving transistors are turned on until potentials at first electrodes of the driving transistors becomes Vdata-Vth, the driving transistors being operated in a constant current region; Vth being a threshold voltage of the driving transistor; and in the corresponding pixel light emitting stage, under the control of the corresponding light emitting control line, controlling, by the light emitting control sub-circuits, second electrodes of the driving transistors to receive a signal from the high level input end, and the driving transistors being operated in a constant current region, light emitting elements being driven to emit light.

8. The method for driving the pixel circuit according to claim 7, wherein the reset voltage input end comprises a ground end or a low level input end, the method further comprises:

setting a full-screen black insertion period between two adjacent display frame times; within the full-screen black insertion period, all light emitting control lines included in the pixel circuit outputting a first level signal, so that second ends of the light emitting elements in each pixel unit circuit included in the pixel circuit all receiving a signal from the reset voltage input end.

9. The method for driving the pixel circuit according to claim 7, wherein the reset voltage input end includes a ground end or a low level input end, the method further comprises:

alternately setting a plurality of full-screen black insertion periods within one display frame time; and in the plurality of full-screen black insertion periods, all the light emitting control lines included in the pixel circuit outputting a first level signal, so that a second end of a light emitting element of each pixel unit circuit included in the pixel circuit receiving a signal from the reset voltage input end.

10. The method for driving the pixel circuit according to claim 7, wherein the reset voltage input end includes a ground end or a low level input end, within one display frame period, the method further comprises:

the plurality of light emitting control lines included in the pixel circuit sequentially outputting a first level signal, so that second ends of the light emitting elements of a plurality rows of pixel unit circuits included in the pixel circuit sequentially receiving a signal from the reset voltage input end.

11. The method for driving the pixel circuit according to claim 7, wherein the reset voltage input end includes a ground end or a low level input end, the method further comprises:

each display frame time includes at least two display periods, within each display period, the plurality of light emitting control lines included in the pixel circuit sequentially outputting a first level signal, so that second ends of the light emitting elements of a plurality rows of pixel unit circuits included in the pixel circuit sequentially receiving a signal from the reset voltage input end.

12. A display device, comprising a silicon substrate and the pixel unit circuit according to claim 1, wherein the pixel unit circuit is arranged on the silicon substrate.

* * * * *